US005347893A

United States Patent [19]

Mikic et al.

[11] Patent Number: 5,347,893

[45] Date of Patent: Sep. 20, 1994

[54] ARCUATE TIP DRIVER

[75] Inventors: Frank Mikic; Jeffrey H. Hoff, both of Kenosha, Wis.

[73] Assignee: Snap-on Incorporated, Kenosha, Wis.

[21] Appl. No.: 23,553

[22] Filed: Feb. 26, 1993

[51] Int. Cl.[5] ..... B25B 15/00

[52] U.S. Cl. ..... 81/436

[58] Field of Search ..... 81/436, 451, 456, 460, 81/461, 441

[56] References Cited

U.S. PATENT DOCUMENTS

| | | | |
|---|---|---|---|
| 370,255 | 9/1887 | Hart | 81/436 |
| 1,361,790 | 12/1920 | Brown | 81/436 X |
| 1,899,489 | 2/1933 | Wickbergh | 81/441 |
| 2,631,624 | 3/1953 | Wright . | |
| 2,677,985 | 5/1954 | Vaughn . | |
| 2,808,087 | 10/1957 | Vaughn | 81/436 |
| 3,175,593 | 3/1965 | Launay | 81/436 |
| 3,695,321 | 10/1972 | Garehime, Jr. . | |
| 3,891,017 | 6/1975 | Iskra . | |
| 4,325,153 | 4/1982 | Finnegan . | |
| 4,528,874 | 7/1985 | Dunn . | |
| 4,590,825 | 5/1986 | Vaughn . | |
| 4,625,598 | 12/1986 | Woltrane | 81/436 |
| 4,670,927 | 6/1987 | Vaughn . | |
| 4,977,800 | 12/1990 | Colvin . | |
| 4,998,454 | 3/1991 | Chaconas et al. . | |

FOREIGN PATENT DOCUMENTS

| | | | |
|---|---|---|---|
| 72601 | 6/1951 | Denmark | 81/451 |

*Primary Examiner*—D. S. Meislin

*Attorney, Agent, or Firm*—Emrich & Dithmar

[57] ABSTRACT

An improved high torque driving tool has a blade with an arcuately convex end surface having a radius of curvature which is greater than the width of the blade and greater than the radius of curvature of the driving slot in an associated fastener. The blade may be provided with a conical tip protects axially from the end surface and has a base diameter substantially equal to the thickness of the blade at the end surface, the tip being receivable in a conical recess and the driving slot of the associated fastener.

6 Claims, 2 Drawing Sheets

ARCUATE TIP DRIVER

BACKGROUND OF THE INVENTION

1. Field of the Invention

The invention relates generally to drivers for fasteners of the types disclosed in U.S. Pat. No. 2,677,985, 4,590,825 and 4,670,927, which have arcuately slotted heads and have come to be known as "high torque" fasteners. Accordingly, drivers for such fasteners have come to be known as "high torque" drivers.

2. Description of the Prior Art

High torque fasteners, such as those disclosed in the aforementioned U.S. patents, typically have a fastener head provided with a generally bow tie-shaped driving slot defined by an arcuately concave bottom wall separating slightly undercut sidewalls. This driving slot is adapted for reception of and engagement by a driving tool blade having an arcuately convex end surface generally matching the curvature of the slot bottom wall. Upon rotation of the driving tool, the undercut geometry of the slot sidewalls cooperates with the driving tool blade to accommodate relatively high torque transfer between the driving tool and the fastener head.

One difficulty experienced with such prior art high torque driving tools and fasteners is a tendency of the driving tool blade to cam out of the driving slot of the fastener head. Since the slot is arcuately concave, its depth, and, therefore the depth of engagement between the driving tool blade and the slot, reduces gradually to zero at the ends of the slot. Thus, in high torque applications, the tool has a tendency to cam out of the slot, beginning at the ends of the slot. This tendency can be aggravated by the buildup of dirt or other debris in the driving slot. Such debris prevents the driving tool blade from bottoming in the slot, thereby reducing even further the engagement depth.

In one form of prior art high torque driving tool, the tool blade has a conical tip which projects axially from the end surface for engagement in a mating conical recess in the driving slot of the fastener to facilitate centering the blade in the slot. This prior art centering tip extends axially inboard of the arcuate end surface of the blade and has a base diameter which is substantially greater than the thickness of the blade at the end surface. This configuration is difficult to manufacture, requiring the use of expensive investment casting techniques.

SUMMARY OF THE INVENTION

It is a general object of the invention to provide an improved high torque driving tool which avoids the disadvantages of prior tools while affording additional structural and operating advantages.

An important feature of the invention is the provision of a driving tool of the type set forth which minimizes cam out of the driving blade from the driving slot of an associated fastener.

In connection with the foregoing feature, another feature of the invention is the provision of a driving tool of the type set forth, which ensures a substantial minimum depth of engagement of the blade in the slot.

Still another feature of the invention is the provision of a driving tool of the type set forth, which is configured to as to provide a clearance space between the end surface of the tool blade and the bottom of the fastener slot.

Still another feature of the invention is the provision of a driving tool of the type set forth, which provides a centering tip which is of simple and economical construction, characterized by ease of manufacture.

These and other features of the invention are attained by providing a driving tool comprising: a shaft having a longitudinal axis, a driving blade at one end of said shaft defined by front and rear surfaces and a pair of side surfaces and an arcuately convex distal end surface intersecting said front and rear surfaces and said side surfaces, said blade having a width which is the distance between said side surfaces at their intersections with said end surface, said end surface having a radius of curvature centered on said longitudinal axis, said radius of curvature being greater than said width.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
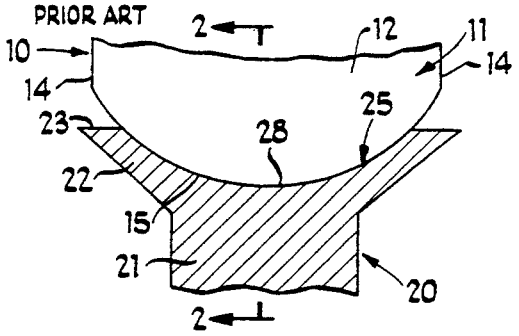
Fig 1 PRIOR ART
FIG. 1 is a fragmentary sectional view illustrating the engagement of a prior art high torque driving tool with an associated fastener.
Figure 2:
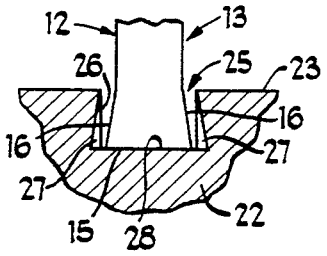
Fig 2 PRIOR ART
FIG. 2 is a fragmentary sectional view taken generally along the line 2—2 in FIG. 1.

Referring to FIGS. 1 and 2, there is illustrated a prior art high torque driving tool 10 having a blade 11 with front and rear surfaces 12 and 13 interconnected by side surfaces 14 and by an arcuately convex end surface 15. The lower ends of the front and rear surfaces 12 and 13 diverge slightly toward the end surface 15, as at 16, and toward the side surfaces 14, resulting in a generally bow tie-shaped configuration. The driving tool 10 is adapted for use with an associated fastener 20 having a threaded shank 21 provided with a head 22 at one end thereof which has a driving face 23 in which is formed a driving slot 25. The driving slot 25 has slightly undercut side walls 26 with outwardly flared end portions 27 and an arcuately concave bottom wall 28, the opposite ends of which respectively intersect the driving face 23.

Thus, it can be seen that the blade 11 and the driving slots 25 have generally complementary bow tie shapes so that the blade 11 is matingly received in the driving slot 25. More specifically, the radius of curvature of the blade end surface 15 is substantially the same as that of the driving slot bottom wall 28 so that the blade 11 bottoms in the slot 25. Typically, the blade 11 has a width which is at least as great as the length of the driving slot 25. Thus, in high torque applications, there is a tendency for the blade 11 to cam out of the driving slot 25 adjacent to the shallow opposite ends thereof. This tendency is aggravated if there is dirt or other debris in the driving slot 25 which prevents the blade 11 from bottoming on the driving slot bottom wall 28 and further reduces the depth of engagement.

Figure 3:
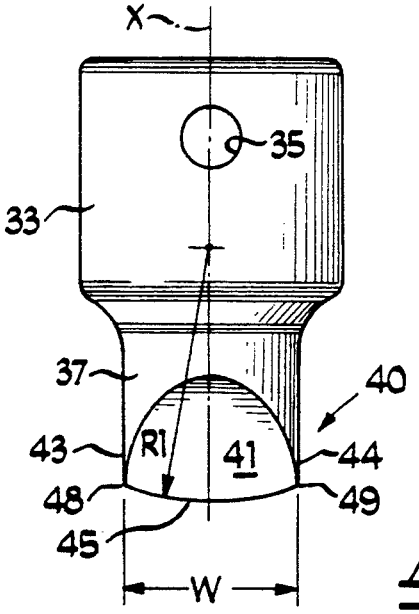
FIG. 3 is a front elevational view of a driving tool constructed in accordance with and embodying the features of a first embodiment of the present invention.
Figure 4:
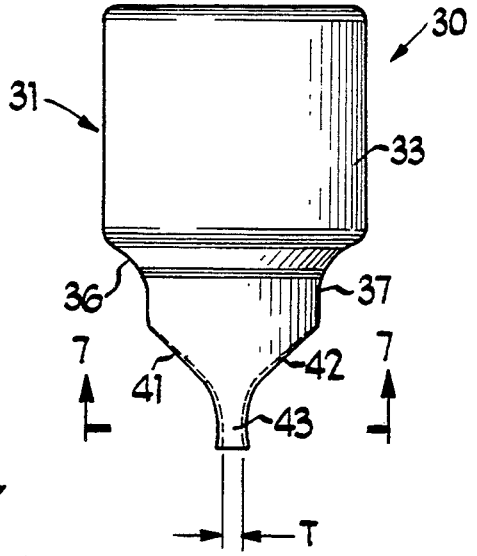
FIG. 4 is a side elevational view of the driving tool of FIG. 3.
Figure 7:
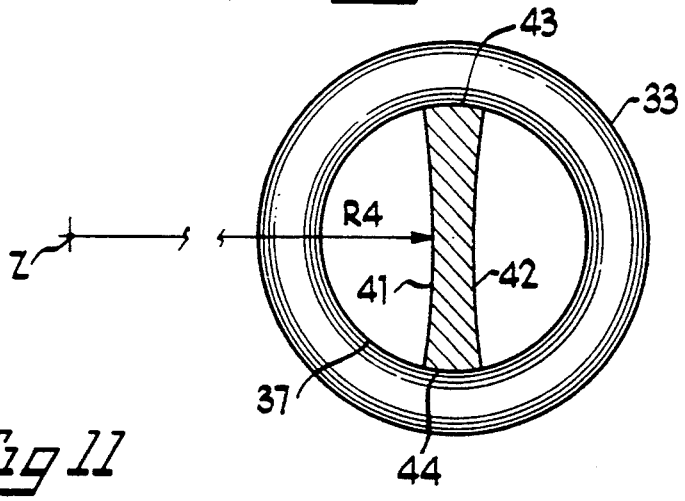
FIG. 7 is an enlarged view in horizontal section taken along the line 7—7 in FIG. 4.

Referring now to FIGS. 3–8, there is illustrated a driving tool 30 constructed in accordance with and embodying the features of a first embodiment of the present invention, which avoids the disadvantages of the prior art construction. The driving tool 30 has an elongated shaft 31 which is generally circularly cylindrical in shape (although it is known to provide a hexagonal shaft, as in a bit constructions, having a longitudinal axis "X" (FIG. 3). The shaft 31 has a main body 33, in one end of which is formed an axial socket 34 (FIG. 6), of known construction, communicating with a radial bore 35 in the side wall of the main body portion 33. The shaft 31 is provided at its other end with a reduced-diameter portion 37 which is joined to the main body portion 33 by a tapered transition portion 36. Formed at the distal end of the reduced-diameter portion 37 is a blade 40 which has front and rear surfaces 41 and 42 interconnected by side surfaces 43 and 44 and by an arcuately convex end surface 45. The end surface 45 has a radius of curvature R1 which is centered on the longitudinal axis "X" (FIG. 3) and which is substantially greater than the radius of curvature R2 of the bottom surface 28 of the fastener driving slot 25 (see FIG. 5). Each of the front and rear surfaces 41 and 42 has an substantially flat portion 46 at its upper end, and an arcuately concave portion 47 at its lower end. The portions 46 converge downwardly, while the portions 47 diverge slightly toward the end surface 45.

The concave lower portion 47 of each of the front and rear surfaces 41 and 42 has a dual concavity. More specifically each lower concave portion 47 has a first radius of curvature R3 centered about an axis "Y" which is substantially orthogonal to the axis "X", i.e., perpendicular to the plane of the paper in FIG. 6, and a second radius of curvature R4 centered on an axis "Z" which is substantially parallel to the axis "X", i.e., perpendicular to the plane of the paper in FIG. 7. In the cross sections of FIGS. 6 and 8 the concave portions 47 respectively terminate in end portions **47*a* which are generally part frustoconical in shape so that, in the cross section of FIG. 8, they define substantially straight lines diverging slightly toward the end surface 45. The R4 concavity causes the concave portions 47, including their end portions 47*a*, to diverge slightly toward the side surfaces 43 and 44**, producing a generally bow tie-shaped configuration.

The convex end surface 45 intersects the side surfaces 43 and 44, respectively, at corner edges 48 and 49 (see FIG. 3). The blade 40 has a width W which is the distance between the corner edges 48 and 49. The blade 40 also has a thickness T, which is the distance between the front and rear surfaces 14 and 42 at their intersections with the end surface 45, midway between the side surfaces 43 and 44 (see FIG. 4). It is a significant aspect of the invention that the radius curvature R1 of the end surface 45 (FIG. 3) is greater than the width W of the blade 40. It will be appreciated that the blade 40 may be provided in a number of different sizes, and the ratio R1/W may vary somewhat from one size blade to another, but the ratio is always preferably between one and two. Preferably also the width W is less than the length of the driving slot 25 in the associated fastener 20.

Figure 5:
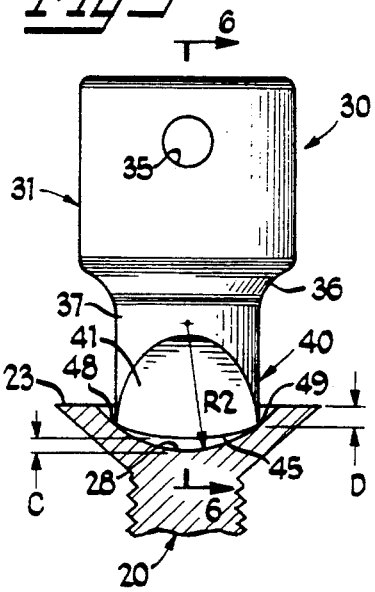
FIG. 5 is a view similar to FIG. 3, showing the tool engaged in the driving slot of an associated fastener which is illustrated in section.
Figure 6:
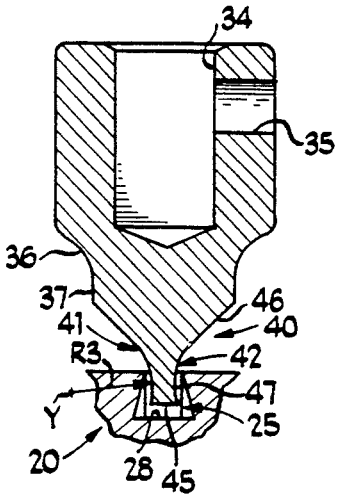
FIG. 6 is a fragmentary view in vertical section taken along the line 6—6 in FIG. 5.
Figure 8:
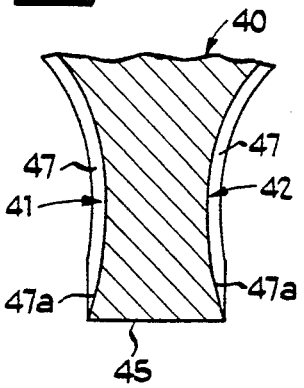
FIG. 8 is an enlarged fragmentary view of the lower end of the blade of the tool illustrated in FIG. 6.

These dimensional relationships produce significant functional advantages. Referring to FIGS. 5 and 6, it can be seen that when the blade 40 is inserted in the driving slot 25 it engages the bottom wall 28 of the driving slot 25 only at the corner edges 48 and 49 and at a significant depth D below the driving face 23. This serves to greatly minimize the tendency of the blade 40 to cam out of the driving slot in high torque applications. Furthermore, it can be seen that the difference in the radii R1 and R2 results in a significant clearance space C between the blade end surface 45 and the driving slot bottom wall 28. This permits accumulation of dirt or other debris in the bottom of the driving slot 25 without significantly affecting the depth of insertion of the blade 40 in the driving slot 25.

Figure 9:
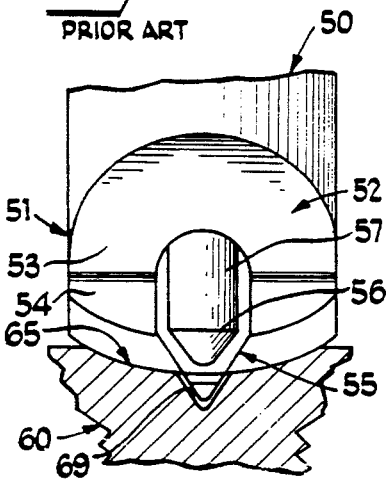
Fig 9 PRIOR ART
FIG. 9 is a fragmentary front elevational view of a prior art driving tool with a conical centering tip, shown illustrated in the driving slot of an associated fastener which is illustrated in section.
Figure 10:
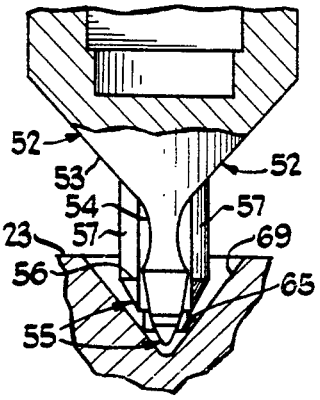
Fig 10 PRIOR ART
FIG. 10 is a fragmentary side elevational view in partial section of the driving tool of FIG. 9.

Referring now to FIGS. 9 and 10, there is illustrated another type of prior art driving tool, generally designated by the numeral 50, which is similar to the prior art driving tool 10, except that the tool 50 has a blade 51 with front and rear surfaces 52 (one shown), each of which has a planar upper portion 53 and an arcuately concave lower portion 54. The blade 51 is also provided with a conical tip 55 substantially coaxial with the longitudinal axis of the driving tool 50 and which projects axially beyond the end surface of the blade 51. The conical tip 50 also extends axially inboard of the end surface of the blade 51 to a base 56 which has a diameter substantially greater than the thickness of the blade 51, and then continues into a generally cylindrical portion 57 which extends upwardly to the planar portions 53 of the front and rear surfaces 52.

The driving tool 50 is adapted for engagement with a fastener 60 which is substantially the same as the fastener 20, described above, except that it has a driving slot 65 provided centrally thereof with a conical recess 69 which extends upwardly all the way to the driving face 23. In use, when the blade 51 is to be engaged in the driving slot 65, the conical tip 55 engages in the conical recess 69 to properly center the blade 51 in the driving slot 65. This greatly facilitates the proper alignment of the blade 51 with the driving slot 65, and permits engagement of the parts by "feel" if, for example, the user cannot clearly see the driving slot 65. However, the driving tool 50 is very difficult and expensive to manufacture, typically requiring the use of costly investment casting techniques.

Figure 11:
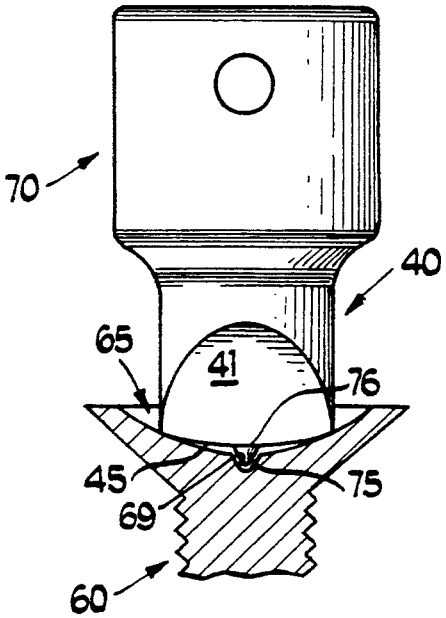
FIG. 11 is a view similar to FIG. 5, illustrating a driving tool in accordance with another embodiment of the invention, shown engaged in the driving slot of an associated fastener.
Figure 12:
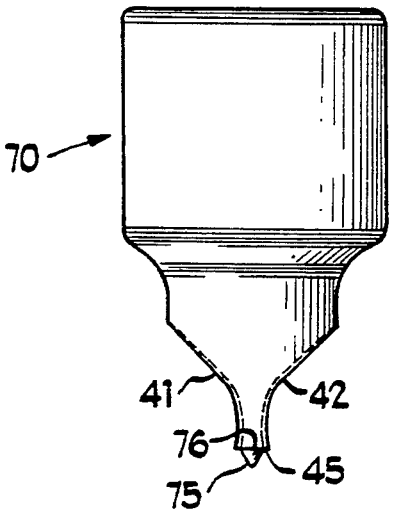
FIG. 12 is a fragmentary side elevational view of the driving tool of FIG. 11.

Referring now also to FIGS. 11 and 12, there is illustrated a driving tool 70 in accordance with a second embodiment of the present invention, adapted for use with the conically recessed fastener 60. The driving tool 70 is substantially identical to the driving tool 30, described above in connection with FIGS. 3–8, except that it is provided with a conical tip 75 coaxial with the longitudinal axis "X" of the driving tool 70 and projecting axially from the end surface 45 of the blade 40. The conical tip 75 has a base 76 which is disposed at the end surface 45 and has a base diameter which is substantially the same as the thickness T of the blade 40. It will be appreciated that the conical tip 75 is dimensioned and disposed for centering engagement in the conical recess 69 of the fastener 60, thereby to serve the same centering function as was described above in connection with the prior art driving tool 50. However, because the conical tip 75 does not extend axially inboard of the end surface 45 and does not extend forwardly and rearwardly outboard of the end surface 45, it can be formed by the same milling cutters and other equipment used to form the driving tool 30, significantly reducing the cost of manufacture as compared with the prior art driving tool 50. Also, since the base diameter of the conical tip 75 is substantially smaller than that of the prior art conical tip 55, the conical recess 69 in the fastener 60 need not extend laterally beyond the side walls of the driving slot 65.

From the foregoing, it can be seen that there has been provided an improved high torque driving tool which is of simple and economical construction and which is adapted for engagement with mating high torque fasteners so as to substantially reduce the tendency to cam out of the fastener slot.

We claim:

1. A driving tool comprising: a shaft having a longitudinal axis, a driving blade at one end of said shaft defined by front and rear surfaces and a pair of side surfaces and an arcuately convex distal end surface intersecting said front and rear surfaces and said side surfaces, each of said front and rear surfaces being arcuately concave about an axis of curvature which is disposed substantially parallel to said longitudinal axis of said shaft, each of said front and rear surfaces being arcuately concave about an axis of curvature which is substantially orthogonal to the longitudinal axis of the shaft, said blade having a width which is the distance between said side surfaces at their intersections with said end surface, said end surface having a radius of curvature centered on said longitudinal axis, said radius of curvature being greater than said width.

2. The driving tool of claim 1, wherein the ratio said radius to said width is between one and two.

3. The driving tool of claim 1, said blade having a thickness which is the distance between said front and rear surfaces at their intersections with said end surface and midway between said side surfaces, and further comprising a generally conical tip formed on said blade substantially coaxial with said shaft and projecting axially from said end surface, said tip having a base at said end surface circular in transverse cross section with a diameter no greater than said thickness of said blade.

4. A driving tool for use in combination and relative high torque engagement with a fastener having a head at one end of a threaded shank, said head having a driving face in which is recessed a driving slot of generally bow tie configuration defined by at least slightly undercut side walls and an arcuately concave bottom wall having a radius of curvature centered on the longitudinal axis of the shank, the slot having a length which is the distance between the intersections of the bottom wall with the driving face as measured along the driving face, said driving tool comprising: a tool shaft having a longitudinal axis, a driving blade at one end of said shaft defined by front and rear surfaces and a pair of side surfaces and an arcuately convex distal end surface intersecting said front and rear surfaces and said side surfaces, each of said front and rear surfaces being arcuately concave about an axis of curvature which is disposed substantially parallel to said longitudinal axis of said shaft, each of said front and rear surfaces being arcuately concave about an axis of curvature which is substantially orthogonal to the longitudinal axis of the shaft, said blade having a width which is the distance between said side surfaces at their intersections with said end surface, said end surface having a radius of curvature centered on said longitudinal axis of said shaft, said width of said blade being substantially less than the length of the slot, said radius of curvature of said blade end surface being greater than the radius of curvature of the bottom wall of the slot.

5. The driving tool of claim 4, and further comprising a generally conical tip formed on said blade substantially coaxial with said shaft and projecting axially from said end surface.

6. The driving tool of claim 5, wherein said blade has a thickness which is the distance between said front and rear surfaces at their intersections with said end surface and midway between said side surfaces, said tip having a base at said end surface circular in transverse cross section with a diameter substantially equal to said thickness of said blade.

* * * * *